US007736752B2

(12) United States Patent
Manhardt et al.

(10) Patent No.: US 7,736,752 B2
(45) Date of Patent: Jun. 15, 2010

(54) PT/PD ALLOY WIRES, STRIPS OR RESHAPED PARTS HARDENED BY OXIDE DISPERSION, AND PROCESS OF PRODUCING THE SAME

(75) Inventors: Harald Manhardt, Bruchkoebel (DE); Carsten Mohr, Gross-Umstadt (DE); David Francis Lupton, Gelnhausen (DE)

(73) Assignee: W.C. Heraeus GmbH, Hanau (DE)

( * ) Notice: Subject to any disclaimer, the term of this patent is extended or adjusted under 35 U.S.C. 154(b) by 0 days.

(21) Appl. No.: 12/031,292

(22) Filed: Feb. 14, 2008

(65) Prior Publication Data

US 2008/0295925 A1 Dec. 4, 2008

Related U.S. Application Data

(63) Continuation of application No. PCT/EP2006/007835, filed on Aug. 8, 2006.

(30) Foreign Application Priority Data

Aug. 15, 2005 (DE) ..... 10 2005 038 772
Nov. 25, 2005 (DE) ..... 10 2005 056 619

(51) Int. Cl.
*C22C 32/00* (2006.01)
*C22C 5/04* (2006.01)

(52) U.S. Cl. ..... 428/670; 75/951; 148/430

(58) Field of Classification Search ..... 75/951; 148/430, 678; 420/463–468; 428/670, 539.5, 428/614

See application file for complete search history.

(56) References Cited

U.S. PATENT DOCUMENTS

| | | | | |
|---|---|---|---|---|
| 3,868,530 | A * | 2/1975 | Eaton et al. | 313/141 |
| 5,129,572 | A * | 7/1992 | Keilberth et al. | 228/131 |
| 2002/0022135 | A1 * | 2/2002 | Kock et al. | 428/434 |
| 2002/0056491 | A1 * | 5/2002 | Manhardt et al. | 148/242 |

FOREIGN PATENT DOCUMENTS

| | | | |
|---|---|---|---|
| DE | 31 02 342 | A1 | 11/1981 |
| DE | 38 32 342 | C1 | 7/1989 |
| DE | 197 14 365 | A1 | 10/1998 |
| DE | 100 46 456 | A1 | 4/2002 |
| DE | 197 58 724 | C2 | 12/2002 |
| EP | 0 447 820 | A2 | 9/1991 |
| EP | 0 533 385 | A1 | 3/1993 |
| EP | 533385 | * | 3/1993 |
| EP | 0 839 553 | A2 | 5/1998 |
| EP | 0 870 844 | A1 | 10/1998 |
| EP | 1 246 330 | A2 | 10/2002 |
| GB | 2299813 | * | 10/1996 |

* cited by examiner

*Primary Examiner*—George Wyszomierski
*Assistant Examiner*—Mark L Shevin
(74) *Attorney, Agent, or Firm*—Panitch Schwarze Belisario & Nadel LLP

(57) ABSTRACT

A wire, strip or reshaped part is produced from an alloy based on platinum, palladium or a mixture of platinum and palladium and hardened by oxide dispersion. The wire, strip or reshaped part cross-section exhibits a peripheral zone in which at least one relatively easily volatilized oxide generator is depleted by at least 25%. In addition, a process is provided for production of such a wire, strip or reshaped part, in which a porous skin is produced thermally on the wire, strip or reshaped part, and the porous skin is compacted by conversion into a soft or impermeable skin.

6 Claims, No Drawings

PT/PD ALLOY WIRES, STRIPS OR RESHAPED PARTS HARDENED BY OXIDE DISPERSION, AND PROCESS OF PRODUCING THE SAME

CROSS-REFERENCE TO RELATED APPLICATIONS

This application is a Continuation of International Application No. PCT/EP2006/007835, filed Aug. 8, 2006, which was published in the German language on Feb. 22, 2007, under International Publication No. WO 2007/019990 A1 and the disclosure of which is incorporated herein by reference.

BACKGROUND OF THE INVENTION

The present invention relates to strips, wires or reshaped parts made of alloys of platinum and/or palladium as the base metals, particularly for use as electrodes in spark plugs. The invention also relates to processes for production of such strips, wires or reshaped parts.

The metals of the platinum group and their alloys have been used for many years as electrodes for spark plugs in combustion engines. Frequently, alloying additions of high-melting non-noble metals (e.g., W) and embedded oxides of the rare earth metals are used in order to minimize wear and tear due to spark erosion in use.

Materials which are particularly suitable for this application are alloys based on Pt with additions of Ir, Ru, W, Mo and/or Re. These alloying elements possess the common characteristic that they oxidize considerably more easily than platinum and form volatile oxides during oxidation.

Pt—Ir alloys hardened by oxide dispersion and other Pt alloys are known, which can be produced by the internal oxidation of non-noble metal components (see, for example, German published patent applications DE 197 14 365 A1 and DE 100 46 456 A1 and German Patent DE 197 58 724 C2). However, it has been found in the course of investigations that these materials have substantial disadvantages, if they are to be used as electrode materials in spark plugs.

Pt alloys containing both proportions of volatile oxide generators ≧5% by weight and proportions of incorporated oxides >0.1% by weight tend to form cracks during processing into thin strips or wires and into electrode tips, which typically have a diameter of <1 mm. In addition, the numerous annealing operations in an oxidizing atmosphere, which are necessary for the manufacture of strips or wire and reshaped parts, lead to undesirable losses of the alloying elements.

BRIEF SUMMARY OF THE INVENTION

It is an object of the present invention to stop the formation of cracks during processing into thin strips or wires or reshaped parts, such as electrode tips (hereinafter often simply referred to as "strip or wire").

The object is achieved by a strip or wire made of an alloy of a noble base metal selected from platinum or palladium or a mixture of platinum and palladium and at least one relatively easily volatilized oxide-forming element, which alloy is hardened by oxide dispersion, and wherein the cross-section of the strip or the wire has a peripheral zone or edge area in which the at least one relatively easily volatilized oxide-forming element is thinned or depleted by at least one quarter (25%).

DETAILED DESCRIPTION OF THE INVENTION

Of decisive importance is a considerable depletion of at least one volatile component in the wire surface or strip surface. For this purpose, depletion by one quarter is sufficient to achieve the desired effect. Preferably, the depletion is greater than one quarter, more preferably greater than one half and most preferably greater than 90%. The depletion is based on the initial mass and/or number of moles of the component to be depleted. According to the invention, an alloy strip or wire is provided, whose composition is based on platinum and/or palladium (hereinafter sometimes referred to as "Pt/Pd"). For this purpose, the proportion by mass of Pt/Pd amounts in total to at least 50% by weight. In this case, the strip or wire comprises an alloy, which is doped with non-noble metal additions and hardened by oxide dispersion. The alloy may contain, as subordinate alloy components, additional neighboring-group elements, such as iron, cobalt, nickel, rhenium, tungsten, tantalum, hafnium, lanthanum, molybdenum, niobium, zirconium, yttrium, titanium, scandium, gold, and lanthanoids.

Of major importance is that the strip or wire has a peripheral or edge zone, in which the volatile components of the alloy are depleted and their volatility under oxidizing conditions is no longer substantial, such that the volatile oxide-forming elements or oxide generators in the strip or in the wire are protected against further oxidation. The depleted peripheral zone is relatively soft and allows crack-free further processing of the strip or wire. It is, moreover, of decisive importance for the jacket to provide protection against further thinning of the components which are volatile under oxidizing conditions or to allow itself to be converted into such a protection.

Thus, an embodiment according to the invention is aimed at initially producing a jacket with a porous zone having a thickness of 20 to 300 μm. The porous zone can be converted into a dense soft outer layer having a thickness of 1 to 50 μm, preferably a thickness of 5 to 20 μm. The strip or wire in this case can have a diameter of 0.05 to 5 mm, preferably 0.1 to 2 mm.

The layer thickness preferably amounts to 0.1 to 5% of the diameter of the strip or wire. In this case, the layer thickness of the dense zone preferably amounts to 0.5 to 5% of the diameter of the strip or wire, more preferably 1 to 2%.

The more volatile components are preferably no longer contained in the skin surface or exhibit a concentration gradient in the skin, such that a concentration gradient from the inner side of the skin to the outer side of the skin exhibits a decrease in the easily volatilized component of at least 25%, preferably 50%, and more preferably in a range of one order of magnitude.

The decrease is relative and is based on the inner concentration, particularly based on the mass or number of moles. The decrease is relative to the inner concentration, i.e., with a decrease of 25%, the outer concentration is 75% of the inner concentration; with a decrease of 50% the outer concentration is only 50%; and with a decrease of one order of magnitude the outer concentration amounts to a fraction of an order of magnitude. The concentration data may be based on the mass or the mole number.

It has been found specifically that, as a result of the presence of a thin layer of largely pure platinum (Pt content >90%, preferably >95%) on the jacket surface of the strip or the wire or the external surface of reshaped parts, the tendency towards cracking can be considerably reduced during processing. The term "jacket surface" is used here in the sense of a jacket surface of a cylinder, synonymous with the surface of a wire or strip resembling a cylinder form. Typical layer thicknesses amount to 0.1-3% of the thickness of the strip or the diameter of the wire. In addition, the layer of largely pure Pt acts as a diffusion barrier, largely preventing further loss of alloy elements by oxidation and evaporation of the oxide. With this layer thickness, the section of the strip or the wire or the reshaped part can be used directly as an electrode without the Pt layer negatively affecting the operation of the electrode. The depleted peripheral zone improves the corrosion resistance of the strip or the wire considerably.

A production process according to the invention for a strip or a wire made of an alloy hardened by oxide dispersion and based on metals of the platinum group, particularly Pt/Pd, comprises thermally generating a porous outer layer on this strip or a wire of a given alloy by thermal treatment of this strip or wire and compacting the porous outer layer by conversion into an impermeable layer.

The Pt/Pd layer can be produced in an advantageous manner in situ. By exposure of a semi-finished product of a Pt/Pd alloy at high temperatures in an oxidizing atmosphere, the alloying element diffuses towards the surface where it oxidizes and evaporates in the form of a volatile oxide. During this process, a soft, porous layer of largely pure Pt/Pd is formed at the surface. In the course of the further conversion to thinner dimensions, the porous layer is compacted into an impermeable layer which operates as a diffusion barrier. The malleability of the Pt/Pd alloy hardened by oxide dispersion is considerably improved by this layer.

Well-established strips or wires based on platinum and/or palladium alloys contain (elements forming volatile oxides, in % by weight):

| | | | |
|---|---|---|---|
| Ir | 0.3-50% | preferably | 10-30% |
| Ru | 0.3-30% | preferably | 3-20% |
| Re | 0.3-20% | preferably | 3-10% |
| W | 0.3-10% | preferably | 1-6% |
| Mo | 0.3-10% | preferably | 1-6% |

➔at least 3% and a maximum of 35% in total.

Well-established doping ranges include:

| | | | |
|---|---|---|---|
| Zr | 0.05-3% | preferably | 0.1-1% |
| Ce | 0.05-3% | preferably | 0.1-1% |
| Y | 0.005-0.3% | preferably | 0.01-0.1% |
| Sc | 0.005-0.3% | preferably | 0.01-0.1% |

Optional alloying elements include:

| | |
|---|---|
| Rh | 0-20% |
| Au | 0-20% |
| Ni | 0-30% |
| Co | 0-25% |
| Fe | 0-10% |

Well-established temperature ranges include:

Internal oxidation of the doping elements: 900 to 1400° C., preferably 900 to 1200° C.

Oxidation treatment for generation of surface zone: 1450 to 1750° C., preferably 1450 to 1650° C.

PRACTICAL EXAMPLES

Example 1

A platinum material strengthened by dispersion was produced according to DE 100 46 456 A1 and DE 197 14 365 A1. For this purpose, an alloy of 3.5 kg Pt and 1.5 kg Ir (corresponding to 5 kg of the alloy PtIr30) was melted under vacuum in a zirconium oxide crucible. After melting and degassing, the melt was doped with 36 g of a master alloy, consisting of Pt with 28% Zr and 2.8% Sc, and was cast in an ingot mold to form an ingot with approximate dimensions of 40 mm×40 mm×150 mm. The analysis of the ingot exhibited a composition of PtIr30 with 1850 ppm Zr and 175 ppm Sc. The ingot was planed in order to eliminate casting defects and was forged at 1000° C. to form a rod with a cross-section of 15 mm×15 mm. Subsequently, the rod was rolled at 1000° C. to form a square wire (4 mm×4 mm). This was exposed for 10 days at 1000° C. in an air atmosphere.

By hot gas extraction analysis (LECO-process), the oxygen content was determined to be 735 ppm. In the case of complete oxidation of the Zr doping to $ZrO_2$ and of the Sc-doping to $Sc_2O_3$, the oxygen content would have been 742 ppm. The wire was divided into three sections, and the individual wire sections were treated differently.

The first wire section was exposed for 8 hours at 1600° C. in an air atmosphere. The metallographic investigation of the transverse section exhibited a porous zone approximately 120 μm thick at the surface. The investigation of this zone by energy dispersive analysis in a scanning electron microscope gave an Ir content which decreased from 19% to 3% from the inner side toward the outer side. This wire section was rolled further as a square profile at 700° C. without problems to a cross-section of 2.4 mm×2.4 mm. After further annealing treatment for 10 minutes at 1000° C. under an air atmosphere, a sample was taken from the wire which was investigated metallographically in the transverse section. The investigation showed a dense outer layer with a uniform fine-grained structure and an average layer thickness of 42 μm. A comparison of the material hardness by the micro-hardness test according to Vickers with a load of 25 kg gave a hardness of 295 for the inner area of the wire cross-section and a hardness of 155 for the center of the outer layer. The transverse section was investigated by energy-dispersive analysis in a scanning electron microscope. The proportion of iridium decreased from 30% in the inner area of the sample to 7% below the outer surface.

The remaining annealed wire was processed further on a conventional wire drawing machine at 25° C. It was possible to draw it to a diameter of 0.6 mm without difficulty. A further investigation in the transverse section showed a dense, soft outer layer with a thickness of approximately 8 μm. It was possible to bend the wire by 180° over a radius of 1 mm, even in the hard-drawn state, without cracks forming.

Spark plug electrode tips for use in automobiles were made from this wire.

Comparative Example 1

The second wire section of Example 1 was rolled further as a square profile at 700° C. without further thermal treatment. Marked transverse cracks occurred after only slight deformation. Further processing work was terminated when a cross-section of approximately 3.5 mm×3.5 mm was reached.

Comparative Example 2

The third wire section of Example 1 was exposed for 8 hours at 1600° C. under an argon atmosphere and rolled further as a square profile at 700° C. First transverse cracks occurred only once a cross-section of approximately 2.8 mm×2.8 mm had been reached.

Example 2

Analogous to Example 1, an alloy of PtIr20 with dopings of 3200 ppm Zr and 350 ppm Y was produced. With a cross-section of 4 mm×4 mm, the material was exposed for 15 days at 1000° C. to an air atmosphere. Processing was carried out in line with the procedure described above for the first wire section.

Example 3

An alloy of PtIr30 doped with 5000 ppm Ce was produced, likewise in a manner analogous to Example 1, and processed into a wire with a diameter of 0.7 mm.

Example 4

An alloy of PtRu10 doped with 1800 ppm Zr and 200 ppm Sc was produced, likewise in a manner analogous to Example 1, and processed into a wire with a diameter of 0.6 mm.

Example 5

An alloy of PtRe10 doped with 1800 ppm Zr and 200 ppm Sc was produced, likewise in a manner analogous to Example 1, and processed into a wire with a diameter of 0.6 mm.

Example 6

An alloy of PtW5 doped with 1800 ppm Zr and 200 ppm Sc was produced, likewise in a manner analogous to Example 1, and processed into a wire with a diameter of 0.6 mm.

Example 7

An alloy of PtMo5 doped with 1800 ppm Zr and 200 ppm Sc was produced, likewise in a manner analogous to Example 1, and processed into a wire with a diameter of 0.6 mm.

Example 8

An alloy of PtIr18W1 doped with 1800 ppm Zr and 200 ppm Sc was produced, likewise in a manner analogous to Example 1, and processed into a wire with a diameter of 0.6 mm.

Example 9

An alloy of PtIr10Ru5 doped with 1800 ppm Zr and 200 ppm Sc was produced, likewise in a manner analogous to Example 1, and processed into a wire with a diameter of 0.6 mm.

Example 10

An alloy of PtRh10Ru5 doped with 1800 ppm Zr and 200 ppm Sc was produced, likewise in a manner analogous to Example 1, and processed into a wire with a diameter of 0.6 mm.

Example 11

An alloy of PtAu3Ir5 doped with 1800 ppm Zr and 200 ppm Sc was produced, likewise in a manner analogous to Example 1, and processed into a wire with a diameter of 0.6 mm.

Example 12

The wires according to Examples 2 through 11 passed the tests carried out in Example 1 in an analogous manner.

Example 13

A platinum material strengthened by dispersion was produced according to DE 100 46 456 A1 and DE 197 14 365 A1. For this purpose, an alloy of 4.0 kg Pt and 1.0 kg Ir (corresponding to 5 kg of the alloy PtIr20) was melted under vacuum in a zirconium oxide crucible. After melting and degassing, the melt was doped with 36 g of a master alloy, consisting of Pt with 28% Zr and 2.8% Sc and was cast in an ingot mold to form an ingot with approximate dimensions of 40 mm×40 mm×150 mm. The analysis of the ingot exhibited a composition of PtIr20 with 1850 ppm Zr and 175 ppm Sc. The ingot was planed in order to eliminate casting defects and forged at 1000° C. to form a rod with a cross-section of 20 mm×10 mm. Subsequently, the rod was rolled at 1000° C. to a thickness of 4 mm. The strip was exposed for 12 days at 1000° C. in an air atmosphere.

By hot gas extraction analysis (LECO-process), the oxygen content was determined to be 725 ppm. In the case of complete oxidation of the Zr doping to $ZrO_2$ and of the Sc doping to $Sc_2O_3$, the oxygen content would have been 742 ppm. The strip was divided into three sections, and the individual strip sections were treated differently.

The first strip section was exposed for 8 hours at 1600° C. in an air atmosphere. The metallographic investigation of the transverse section exhibited a porous zone approximately 120 μm thick at the surface. The investigation of this zone by energy dispersive analysis in a scanning electron microscope gave an Ir content which decreased from 14% to 2% from the inner side toward the outer side. This strip section was rolled further at 700° C. without problems to a thickness of 1.5 mm. After further annealing treatment for 10 minutes at 1000° C. under an air atmosphere, a sample was taken from the strip which was investigated metallographically in the transverse section. The investigation exhibited a dense outer layer with a uniform fine-grained structure and an average layer thickness of 30 μm. A comparison of the material hardness by the micro-hardness test according to Vickers with a load of 25 kg gave a hardness of 225 for the inner area of the strip cross-section and a hardness of 145 for the center of the outer layer. The transverse section was investigated by energy-dispersive analysis in a scanning electron microscope. The proportion of iridium decreased from 20% in the inner area of the sample to 5% below the outer surface.

The remaining annealed strip was rolled further at 25° C. It was possible to roll it to a thickness of 0.4 mm without difficulty. A further investigation in the transverse section showed a dense, soft outer layer with a thickness of approximately 7 μm. It was possible to bend the strip by 180° over a radius of 1 mm, even in the hard-drawn state, without cracks forming.

Discs with a diameter of 1.2 mm were punched out of this strip and installed as spark plug electrodes for use in gas motors.

Comparative Example 3

The second strip section was rolled further at 700° C. without any further thermal treatment. Marked cracks occurred after only a slight deformation. Further processing was terminated when a thickness of 2.8 mm was reached.

Example 14

An alloy of PtW5 doped with 3200 ppm Zr and 350 ppm Sc was produced, likewise in a manner analogous to Example 1, and processed into a strip with a thickness of 0.3 mm. Discs with a diameter of 1.5 mm were punched out of this strip and used as spark plug electrodes in automobile engines. The strips according to Example 14 passed the tests carried in Example 13 in an analogous manner.

Comparative Example 4

The third strip section was exposed for 8 hours at 1600° C. in an argon atmosphere and rolled further at 700° C. First cracks appeared only when a thickness of approximately 2.2 mm was reached.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A strip, wire or reshaped part, comprising an alloy of a base metal selected from platinum, palladium or a mixture of platinum and palladium and at least one oxide generator which forms a volatile oxide that is more volatile than other alloy components, the alloy being hardened by oxide dispersion and the at least one oxide generator being selected from 0.3 to 50% by weight of iridium, 0.3 to 30% by weight of ruthenium, 0.3 to 20% by weight of rhenium, 0.3 to 10% by weight of tungsten, and 0.3 to 10% by weight of molybdenum, wherein the platinum and/or palladium comprise at least 50% by weight of the alloy and the at least one oxide generator comprises in total 3% to 35% by weight of the alloy, and wherein a cross-section of the strip, wire or reshaped part has a peripheral zone amounting to 0.1 to 5% of a thickness of the strip, wire or reshaped part, the at least one oxide generator being depleted by at least one quarter in the peripheral zone.

2. The strip, wire or reshaped part according to claim 1, wherein the strip, wire or reshaped part has a sheathing of platinum or palladium or a platinum-rhodium alloy or a platinum-gold alloy.

3. The strip, wire or reshaped part according to claim 2, wherein alloy components of the platinum and/or palladium in the peripheral zone exhibit a concentration gradient from inner side toward outer side of the zone with a decrease in concentration to half or less than the inner side concentration.

4. The strip, wire or reshaped part according to claim 1, wherein the peripheral zone is porous and has a thickness of 20 to 300 μm.

5. The strip, wire or reshaped part according to claim 1, wherein the strip, wire or reshaped part has a thickness of 0.05 to 5 mm and a dense, soft peripheral zone having a thickness of 1 to 50 μm.

6. The strip, wire or reshaped part according to claim 1, having a form of a spark plug electrode.

* * * * *